United States Patent [19]

Lima et al.

[11] Patent Number: 4,787,637

[45] Date of Patent: Nov. 29, 1988

[54] GOLF TEE WITH COMPRESSION INSERT

[76] Inventors: Richard J. Lima, 844 Sevely, Mountain View, Calif. 94041; John Remen, 3805 Magnolia Dr., Palo Alto, Calif. 94306; Robert N. Wilms, 10340 Castine Ave., Cupertino, Calif. 95814

[21] Appl. No.: 36,289

[22] Filed: Apr. 8, 1987

[51] Int. Cl.[4] ..... A63B 57/00

[52] U.S. Cl. ..... 273/212; 273/211

[58] Field of Search ..... 273/201, 203, 204, 205, 273/206, 207, 208, 209, 210, 211, 212, 33

[56] References Cited

U.S. PATENT DOCUMENTS

| | | | |
|---|---|---|---|
| 1,616,683 | 2/1927 | Eddy | 273/33 |
| 1,645,001 | 10/1927 | Hodges | 273/33 |
| 1,699,934 | 1/1929 | Warner | 273/211 |

*Primary Examiner*—Richard C. Pinkham
*Assistant Examiner*—T. Brown
*Attorney, Agent, or Firm*—Thomas Schneck

[57] ABSTRACT

A golf tee including a rigid tee body having a downwardly tapered stem for insertion into soil or the like. A ball seat is disposed above the rigid tee body. The ball seat has at least one ball-supporting structure with a downwardly inclined surface having a contour substantially similar to the contour of the peripheral surface of a golf ball. The ball seat further has at least one depressed region spacing apart said downwardly inclined surfaces of the ball-supporting structures. A graphite insert is disposed along the axial bore of the rigid tee body. The graphite insert extends partially through the rigid tee body and has a portion extending from the axial bore for contact with a golf ball supported atop said ball seat.

18 Claims, 2 Drawing Sheets

GOLF TEE WITH COMPRESSION INSERT

Technical Field

The present invention relates generally to apparatus used for supporting a golf ball above a playing surface.

BACKGROUND ART

In addressing a golf ball supported on a tee a golf club will momentarily deform the ball, compressing the ball in the direction of golf club movement. As a golf ball is deformed by the impact with a golf club, the ball expands in the direction of the tee and a significant amount of energy is expended in increased drag. Because of the speed of the golf club head, the tee is not normally displaced into the soil but is, instead, compressed. Additional energy is lost for purposes of golf ball flight if ball deformation creates a suction between the golf ball and the cup-like seat of a golf tee.

Prior art patents have addressed the problem of golf tees impeding the initial acceleration of a ball. U.S. Pat. No. 3,575,420 to Turner discloses a plastic golf tee which is hinged so that the tee will pivot in a forward direction when a ball is struck by a club. U.S. Pat. No. 2,011,203 to Seiki teaches use of a hollow tee member made of a light weight material such as paper, cardboard or fiber. Because the tee member is made of a light weight material, drag is reduced. The tee member of Seiki is inserted into the ground by a plug which is removed prior to resting a ball on the tee member. U.S. Pat. No. 4,192,504 to Clugage discloses a golf tee having a fin on a curved stem and having a rib formed in the ball-supporting socket. The purpose of the fin is to facilitate alignment and the purpose of the rib is to eliminate the suction between a ball and a tee. Such extreme departures from the construction of conventional golf tees lead to difficulty in gaining sanctioning by the rules committees of major golf associations.

U.S. Pat. No. 2,455,705 to Seager is concerned with the suction between a golf ball and a tee. The golf tee of Seager includes a plurality of narrow ribs at the ball-supporting area of the tee. While the Seager tee is more in keeping with conventional golf tees than are the above-described inventions, the narrow ribs only slightly resemble the cupped surface of the conventional golf tee. The same is true of U.S. Pat. Nos. 1,638,527; 1,644,979; 1,644,980 and 1,658,226, all to Clausing.

The prior art does indeed increase the ratio of kinetic energy of the ball in flight to kinetic energy of the golf club upon contact with the ball. The above-described patents increase the ratio, however, by focusing on reducing frictional or static energy lost at the tee. It is an object of the present invention to provide a golf tee which closely resembles a conventional golf tee but which minimizes both static and dynamic energy lost to the tee.

DISCLOSURE OF THE INVENTION

The above object has been met by a golf tee having an energy storage means incorporated into a ball-supporting structure that includes the concave region that is common to conventional golf tees. The present invention will momentarily store the energy received by the deformation of the golf ball and will then transfer that energy back to the ball as the ball leaves the tee. As a result, the ball receives an additional "kick" from the tee for an extended drive in a desired direction.

The energy storage means is a compression member, preferably selected to be a graphite insert, axially disposed in a hardwood tee body. The graphite insert is slightly smaller in diameter than a stem of the conventional tee but does not extend through the stem. The graphite insert projects slightly above the base of the ball-supporting structure so as to contact the surface of a golf ball. The axially disposed insert preferably has a cylindrical shape having a diameter in the range of 0.0625 inches and 0.0125 inches and having a length of 0.375 to 0.5 inches.

Graphite has the characteristic of being moderately elastic. A properly stroked golf ball will compress in the direction of the contact and will expand substantially in direction of a golf tee. The insert of the present invention will momentarily store the energy of this deformation by compressing. Then, as the ball leaves the tee the potential energy of the compressed insert is returned to the ball as the resilient insert returns to its original shape.

Additionally, graphite is a material having a low coefficient of friction and, therefore, less energy is expended in forcing a ball from a tee than would be expended if the ball were in contact with a material that offered a greater frictional drag. Because less energy is expended, a ball will leave a tee with a greater amount of potential energy in the form of ball deformation. Besides its resiliency and its low coefficient of friction, a third advantage of graphite is that, like the wood of a conventional golf tee, graphite is frangible, i.e. less sturdy than a golf club head or the cover of a golf ball. Thus, if a ball is improperly stroked, the graphite insert could fracture, but the insert will not damage the golf club or ball. The same would not be true of metal inserts.

A further characteristic of the present invention is that the ball-supporting structure includes at least one depressed region for the purpose of decreasing contact friction with the ball. Again, this amounts to less energy absorption by the tee. Various embodiments are possible but in all embodiments the ball-supporting structure retains the concave regions common to traditional golf tees.

BEST MODE FOR CARRYING OUT THE INVENTION

Figure 1:
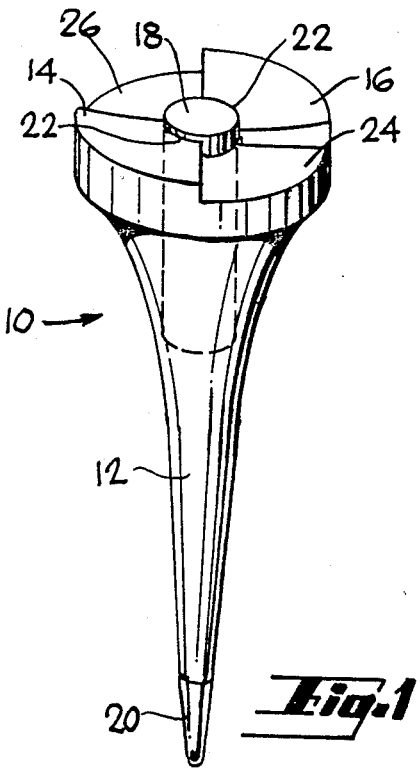
FIG. 1 is a perspective view of a golf tee in accord with the present invention.
Figure 2:
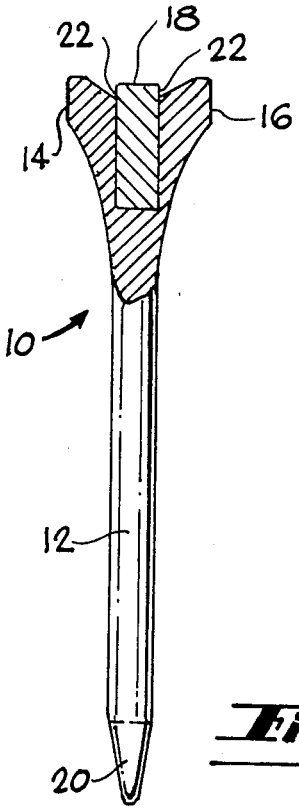
FIG. 2 is a partially sectional side view of the golf tee of FIG. 1.
Figure 3:
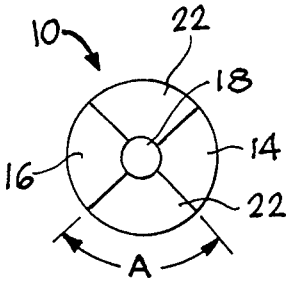
FIG. 3 is a top view of the golf tee of FIG. 2.

With reference to FIGS. 1–3, the golf tee 10 of the present invention includes a stem 12, a pair of ball-supporting structures 14 and 16 and a graphite insert 18. The stem 12 has an elongated, substantially conical shape and has a pointed tip 20 to facilitate insertion of the golf tee into soil. The stem 12 and the ball-supporting structures 14 and 16 are preferably integral, having an aggregate length of approximately 2.125 inches and made of a hardwood, such as maple.

The ball-supporting structures 14 and 16 each have an upper surface which is downwardly inclined toward the stem 12. The ball-supporting structures combine to form a tee seat for supporting a golf ball. The upper surfaces of the tee seat are typically concave and have a curvature corresponding substantially to the curvature of a golf ball. The ball-supporting structures are sectors that have curved base edges 22 and the structures are spaced apart by depressed regions 24 and 26. As will be described more fully below, the purpose of the depressed regions 24 and 26 is to reduce the contact friction present whenever a golf ball is struck from the tee seat. A depressed region of the golf tee 10 optionally has an arc A of 45° but the exact arc is not critical. In use, a depressed region is aligned with the desired path of golf ball flight.

The insert 18 is cylindrical in shape and is disposed along the longitudinal axis of the golf tee 10, projecting somewhat above the base edges 22 of the ball supporting structures 14 and 16. The insert is preferably graphite, i.e. crystalline carbon, of electrode quality. Graphite has a moderate elasticity, comparable to some metals, yet unlike most metals is frangible if impacted severely. The graphite insert 18 has an exposed upper surface for contact with a golf ball supported by the golf tee 10.

Figure 4:
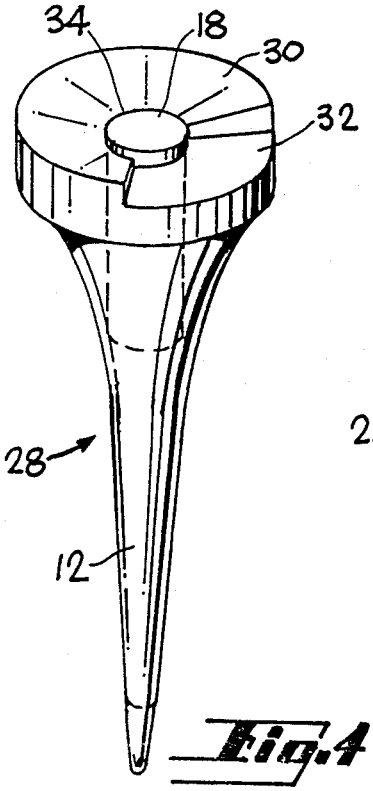
FIG. 4 is a perspective view of a second embodiment of the present invention.
Figure 5:
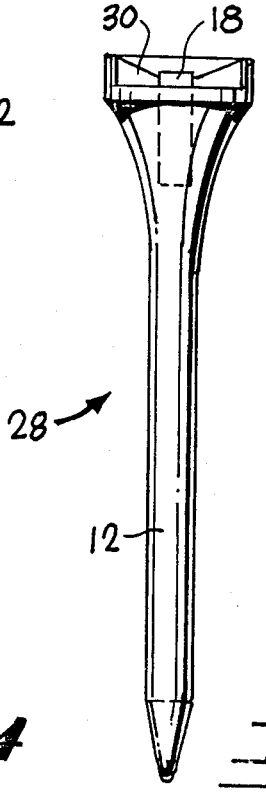
FIG. 5 is a side view of the golf tee of FIG. 4.
Figure 6:
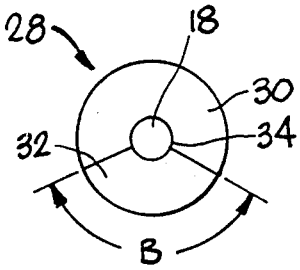
FIG. 6 is a top view of the golf tee of FIG. 5.

FIGS. 4–6 illustrate a second embodiment of the present invention. The golf tee 28 is similar to the golf tee of FIG. 1, having a stem 12 and a graphite insert 18. The golf tee 28, however, has a single ball-supporting structure 30 and a single depressed region 32. The depressed region has an arc B of approximately 60°, but while an arc of 60° is preferred, it is not critical. Again, the graphite insert extends above the base edge 34 of the ball-supporting structure 30 for contact with a ball supported by the golf tee 28.

Figure 7:
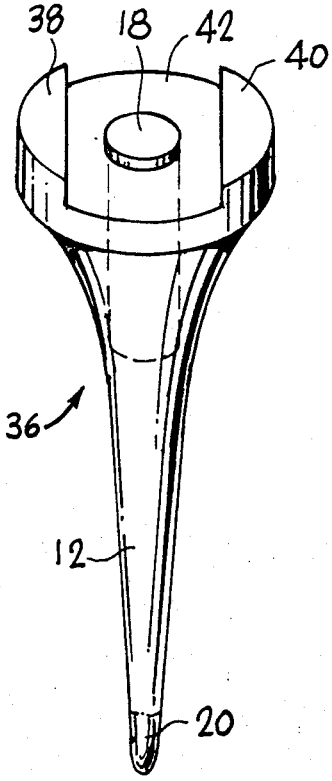
FIG. 7 is a perspective view of a third embodiment of the present invention.
Figure 8:
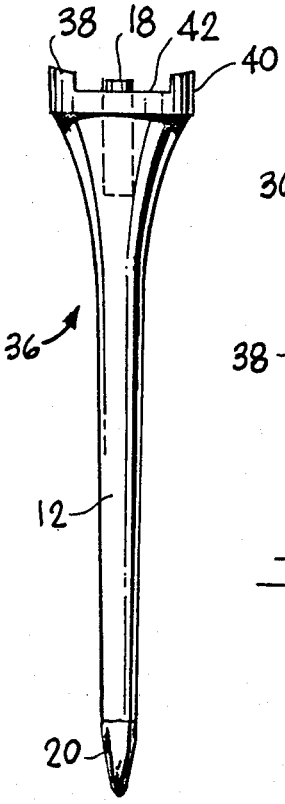
FIG. 8 is a side view of the golf tee of FIG. 7.
Figure 9:
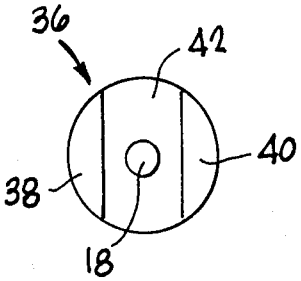
FIG. 9 is a top view of the golf tee of FIG. 8.

Referring now to FIGS. 7–9, a third embodiment of the present invention includes a golf tee 36 having a pair of ball-supporting structures 38 and 40 spaced apart by a flight alignment slot 42. The structures 38 and 40 have downwardly inclined surfaces to position a ball atop a graphite insert 18. A stem 12 has a pointed tip 20 for insertion into the soil of a golf course. The flight alignment slot 42 has a length that traverses the golf tee 36 and has a width of 0.25 inches. While the dimensions of the slot 42 are not critical, the slot should leave sufficient ball-supporting structure to securely position a golf ball atop the graphite insert 18. In use, the slot 42 is aligned parallel to the desired direction of ball flight.

Figure 10:
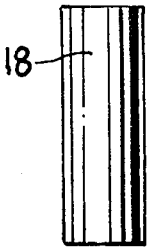
FIG. 10 is a side view of a graphite insert of FIG. 1.
Figure 11:
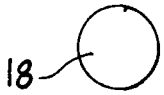
FIG. 11 is top view of the graphite insert of FIG. 10.

FIGS. 10 and 11 show that the graphite insert 18 has a cylindrical shape. The insert 18 is slightly smaller in diameter than the stem of a golf tee but does not extend into the stem. Preferably, the graphite insert has a diameter in the range of 0.0625 inches and 0.125 inches and has a length in the range of 0.375 inches and 0.5 inches. The graphite insert should extend somewhat above the axial aperture in the golf tee which houses the insert.

Three characteristics of graphite make the material ideal for use in the present invention. The first characteristic involves the elasticity of graphite. A cylinder of graphite is highly resilient, especially in the axial or load-bearing direction, and will by its nature be urged to an original state after undergoing axial compression. Thus, in the present invention, the graphite insert will act as an energy storage means when compressed by a deformed golf ball.

A second characteristic of graphite is the low coefficient of friction of the material. Because of the low coefficient of friction of graphite, less contact friction is experienced by a golf ball that has been stroked from the present golf tee than is experienced by a ball hit from a conventional wood tee. Therefore, less energy will be lost for purposes of ball flight.

Finally, graphite is frangible, i.e. not as rigid as the cover of a golf ball or the head of a golf club. As a consequence, the graphite insert 18 will not cut the golf ball or scratch the golf club head even when a ball is hit improperly and the tee is impacted.

Figure 12:
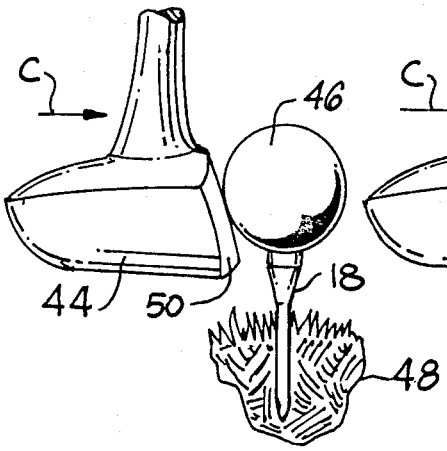
FIGS. 12–14 are illustrations of a golf club head striking a ball positioned upon the golf tee of FIG. 1.
Figure 13:
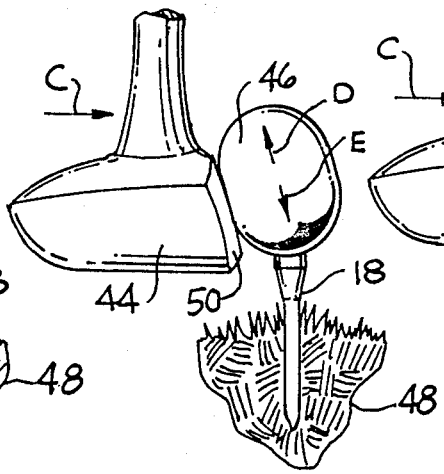
Figure 14:
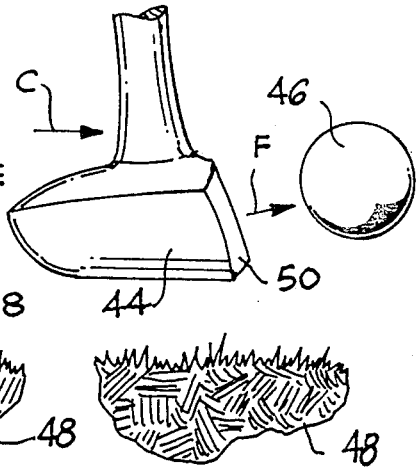

In operation, FIGS. 12–14 illustrate a golf club head 44 stroking a golf ball 46 from a tee 18. Prior to positioning of a ball 46, the golf tee 18 is pressed into the soil 48 with a depressed region, not shown, in alignment with the desired direction of flight. The ball 46 is then rested atop the golf tee 18 and is ready for play. As shown in FIGS. 12 and 13, a golf club head moving in the direction of Arrow C initially contacts a spherical golf ball but the contact deforms the ball, compressing the ball in a direction perpendicular to the striking face 50 of the golf club and causing the ball to expand in the direction of Arrows D and E.

Initially, the only compression force on the graphite insert of the golf tee 18 is from the weight of the golf ball 46. This force is substantially negligible. However, as the golf ball 46 deforms in the direction of Arrow E a certain amount of displacement must occur to the tee 18 and this displacement requires energy from the golf ball. Typically, because of the tremendous speed of the golf club head 44, a golf tee is not driven further into the ground as much as it is compressed. This is particularly true if the tee is in very firm soil. A conventional wooden or plastic golf tee will thereby absorb energy and this energy is lost for purposes of golf ball flight. The graphite insert of the present invention, however, will store the energy for return to the golf ball. In the same manner that the golf ball 46 of FIG. 13 stores energy by the fact that the ball is deformed, the compression of the graphite insert stores potential energy. Then as the ball is driven from the golf tee, the spring-like action of the graphite insert restores the absorbed energy to the golf ball. The result is a longer and truer flight when the ball is struck. Additionally, since the graphite insert has a low coefficient of friction, less energy absorbing contact friction occurs between the ball and the tee.

Frictional drag is reduced further by the depressed regions, not shown, of the golf tee. Golf ball deformation pushes the ball down into the tee. In all circumstances this will cause increased frictional drag, but when ball deformation causes a suction between the golf ball and a golf tee the increased drag is particularly detrimental to ball flight. The depressed regions of the present invention, however, eliminate any risk of a suction occurring and, in all cases, reduce frictional drag. A golf ball 46 will therefore have greater potential energy for repelling itself from the striking face 50 of a golf club. Golf ball flight is shown by Arrow F of FIG. 14.

For purposes of obtaining sanctioning, the tee body of the present invention has been designed to closely resemble a conventional golf tee. It is to be understood, however, that the graphite insert may be utilized with tee bodies having various configurations. Moreover, the insert itself may have other shapes, although it has been discovered that the cylindrical shape offers the best results. While graphite is a preferred material, there may be other materials having similar properties of elasticity, frangibility and low friction.

We claim:

1. A golf tee for insertion into soil comprising,
a tee body having a stem and a longitudinal axis,
a ball-supporting means atop said tee body for supporting a golf ball, and
a frangible, resiliently compressible insert extending partially through said tee body along said longitudinal axis, said insert having an upper exposed surface disposed for contact with a golf ball supported by said ball-supporting means, said insert having a length relative to said longitudinal axis of the tee body within the range of 0.3 inches to 0.6 inches.

2. The golf tee of claim 1 wherein said insert is graphite.

3. The golf tee of claim 2 wherein said insert is a cylindrical member having a diameter in the range of 0.05 inches to 0.15 inches.

4. The golf tee of claim 1 wherein said tee body and said ball-supporting means are integral and are made of wood.

5. The golf tee of claim 1 wherein said ball-supporting means is a ball seat having structure defining at least one concave region and at least one depressed region, each concave region having a curvature corresponding substantially to the curvature of the peripheral surface of a golf ball, each concave region having a curved upper rim and a base edge, each depressed region having an axially inward extent substantially coterminous with the base edge of an adjacent concave region.

6. The golf tee of claim 5 wherein said exposed surface of the insert is extended above the base edge of each concave region.

7. The golf tee of claim 5 wherein said ball seat has a single concave region, said curved upper rim of the concave region having an arc in the range of 280° and 320°.

8. The golf tee of claim 5 wherein said ball seat has a pair of opposed truncated wedge-shaped concave regions spaced apart by a single depressed region, said concave regions having parallel base edges.

9. The golf tee of claim 1 wherein said insert is made of a material less rigid than the outside surface of a conventional golf ball.

10. The golf tee of claim 1 wherein said insert is made of a material having a resilience exceeding the resilience of said tee body.

11. A golf tee comprising,
a rigid tee member having a stem for insertion into soil, said rigid tee member having a ball-supporting area and a graphite core, said ball-supporting area having at least one depressed region defined by opposed, substantially isomorphic ball-supporting structures, each ball-supporting structure having a surface downwardly inclined towards said stem to define an inclined region having a base and each having a sectorial upper rim having an arc within the range of 125° to 145°, said graphite core extending upwardly from said stem into said ball-supporting area above said base.

12. The golf tee of claim 11 wherein said graphite core is a cylindrical graphite insert.

13. The golf tee of claim 11 wherein each ball-supporting structure has a sectorial upper region.

14. The golf tee of claim 13 having a pair of opposed substantially isomorphic ball-supporting structures, each having a truncated wedge-shaped configuration.

15. A golf tee for insertion into soil comprising,
a tee body having a stem and a longitudinal axis,
a ball seat having opposed, substantially symmetrical concave regions spaced apart by opposed depressed regions, each concave region having a curvature corresponding substantially to the curvature of a peripheral surface of a conventional golf ball, each concave region having a curved upper rim and a base edge, said curved upper rims of the concave regions each having an arc in the range of 125° to 145°, and
a frangible, resilient graphite insert extending partially through said tee body along said longitudinal axis, said graphite insert having an upper exposed surface disposed for contact with a golf ball supported by said ball seat.

16. The golf tee of claim 15 wherein said insert is a cylindrical member having a diameter in the range of 0.05 inches to 0.15 inches.

17. The golf tee of claim 15 wherein said insert has a length relative to said longitudinal axis of the tee body within the range of 0.3 inches to 0.6 inches.

18. The golf tee of claim 15 wherein said exposed surface of the insert is extended above the base edge of each concave region.

* * * * *